United States Patent [19]

Berg

[11] Patent Number: 4,541,662

[45] Date of Patent: Sep. 17, 1985

[54] LIFTING LUG FOR SHIPPING CONTAINERS

[76] Inventor: Cyrus Berg, Box 8, P.O., Elandshoek, South Africa, 1208

[21] Appl. No.: 542,280

[22] Filed: Oct. 17, 1983

[51] Int. Cl.[4] ..... B66C 1/66

[52] U.S. Cl. ..... 294/82.1

[58] Field of Search ..... 294/82 R, 78 R, 74, 294/67 D, 67 DA, 67 DB, 67 E, 67 EA, 89, 86 R; 24/230.5 R, 221 R; 52/125, 698, 700, 701, 702, 703, 704, 706, 707

[56] References Cited

U.S. PATENT DOCUMENTS

| | | | |
|---|---|---|---|
| 3,392,892 | 2/1974 | Shields | 294/82 R |
| 4,068,878 | 1/1978 | Wilner | 294/82 R |
| 4,088,361 | 5/1978 | Ditcher | 294/82 R |
| 4,139,228 | 2/1979 | Varadi | 294/82 R |

*Primary Examiner*—James B. Marbert

*Attorney, Agent, or Firm*—Wells, St. John & Roberts

[57] ABSTRACT

A lifting lug for shipping containers includes an elongated bar having a fitting at one end for receiving the free end of a choker cable and an angularly oriented locking keeper member at an opposite end. The keeper member is rigidly affixed to the bar such that the bar must be pivoted to a particular angular orientation to allow insertion of the keeper member through an appropriate slot in a standard shipping container. Then the bar is pivoted to another angular orientation to lock the keeper member in position behind the slot. This angular orientation is such that tension of the choker cables will maintain the bar in the locked position. The locked orientation of the bar is thereby assured so long as tension is maintained along the choker cables. An indicator is provided on an outside surface of the bar to show the operator the present angular orientation of the keeper member within the cargo container lift fitting.

19 Claims, 8 Drawing Figures

FIG 4
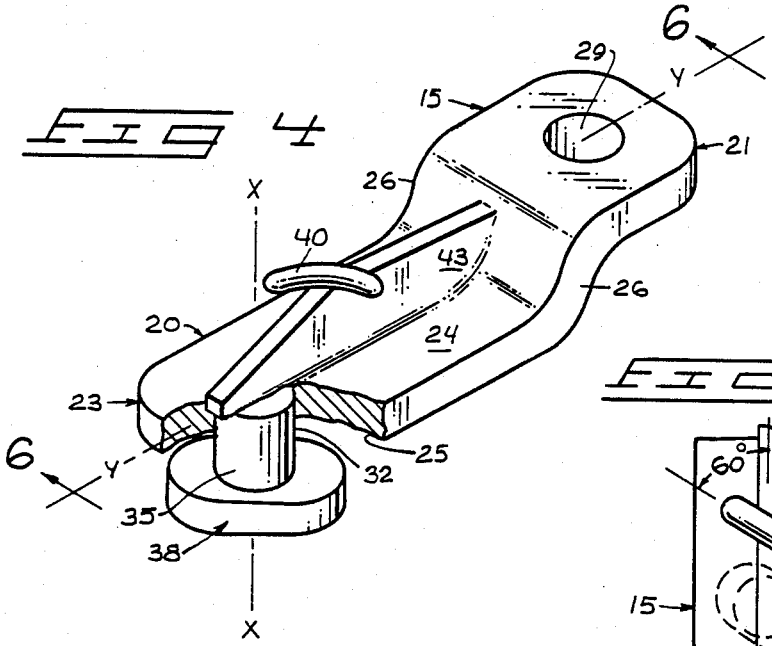
FIG 8
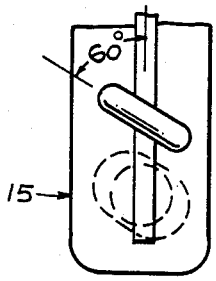
FIG 5
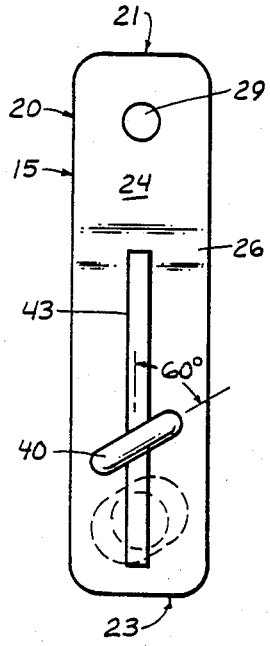
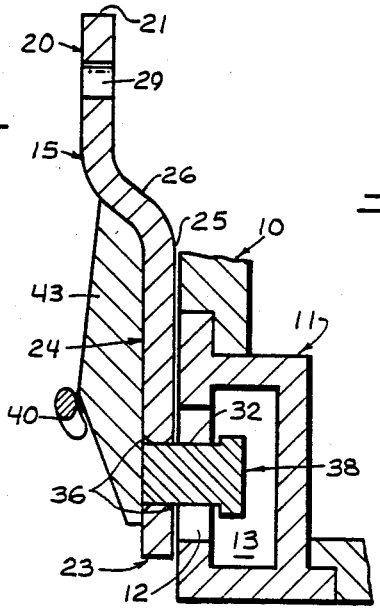
FIG 6
FIG 7
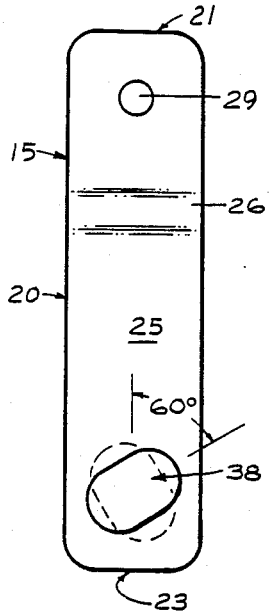

LIFTING LUG FOR SHIPPING CONTAINERS

FIELD OF THE INVENTION

The present invention relates to attachment and detachment of cargo shipping containers to lifting cranes for the purpose of moving the cargo containers.

BACKGROUND OF THE INVENTION

Large shipping containers have been fairly standardized in the maritime freight shipping industry. They are typically handled in large ports by loading and unloading derricks. Such derricks usually include an automated clamp or connector for attaching and disconnecting the huge crates. However, small ports using only cranes and small derricks do not have such facilities. They typically include a cable hoist having a central hoist hook with choker cables. The ends of the chokers often include shackles that can be connected only at the top corners of the containers. This process takes approximately twenty minutes for each container since the dock worker must climb to each top corner of the container and manually connect a shackle. The same process must be repeated for removing the shackles and chokers.

This problem has been realized to a limited degree by provision of "quick disconnect" lifting lugs for the shipping containers.

U.S. Pat. No. 4,139,228 to Thomas Varadi discloses a locking device for connection to shipping container lift fittings. The device includes a manual lock pin arrangement that can be fitted through the typical slot at the lift fitting and turned to a locked position. The pin is connected to a handle device that can be locked upon turning to an appropriate position through a spring-biased pin arrangement. This device includes several moving parts and requires several steps to lock it into place. The time consumed in placing and removing the device is substantial. Furthermore, the chance for error in positioning the device increases with the number of steps that must be performed by the dock worker in attaching and detaching the assemblies from the containers.

A somewhat similar lift coupling is disclosed in U.S. Pat. No. 4,068,878 to Irving Wilner. This patent discloses a rotatable locking lug that fits within the appropriate slots of a shipping container for connection to choker hooks. The device includes two relatively movable locking members that can be turned relative to one another and fitted in a cruciform configuration to lock the device into position. The device is preferably used along the top horizontal surfaces of the shipping container to avoid bending the central pivot shaft. If the device were to be used on the vertical sides or bottom corners of the container, lifting forces could quite easily bend the shank and inhibit or prevent pivotal motion of the locking members. The result could be the inability to remove the "jammed" lugs from the containers. It is important that no projections extend from the shipping containers as packing of the containers in tight quarters is necessary and such projections would damage adjacent containers.

It therefore has remained desirable to obtain some form of lifting lug arrangement for standard shipping containers that will enable quick and safe attachment and detachment of choker cables to shipping containers and that will remain reliable for use over an extended period of time.

BRIEF DESCRIPTION OF THE DRAWINGS

A preferred form of the present invention is illustrated in the accompanying drawings in which:

FIG. 4 is a partially fragmented pictorial view of the present lug;

FIG. 5 is a elevation view of the present lug;

FIG. 6 is a longitudinal section through the present lug and a portion of a cargo container and associated corner fitting;

FIG. 7 is an elevation view illustrating a side of the lug opposite that shown in FIG. 5; and FIG. 8 is a fragmented view similar to FIG. 5 only showing a "left hand" version of the lug for use on the side of a shipping container opposite that side receiving the lug shown in FIG. 5.

DETAILED DESCRIPTION OF A PREFERRED EMBODIMENT

The following disclosure is submitted in compliance with the constitutional purpose of the Patent Laws "to promote the progress of science and useful arts" (Article 1, Section 8).

Figure 1:
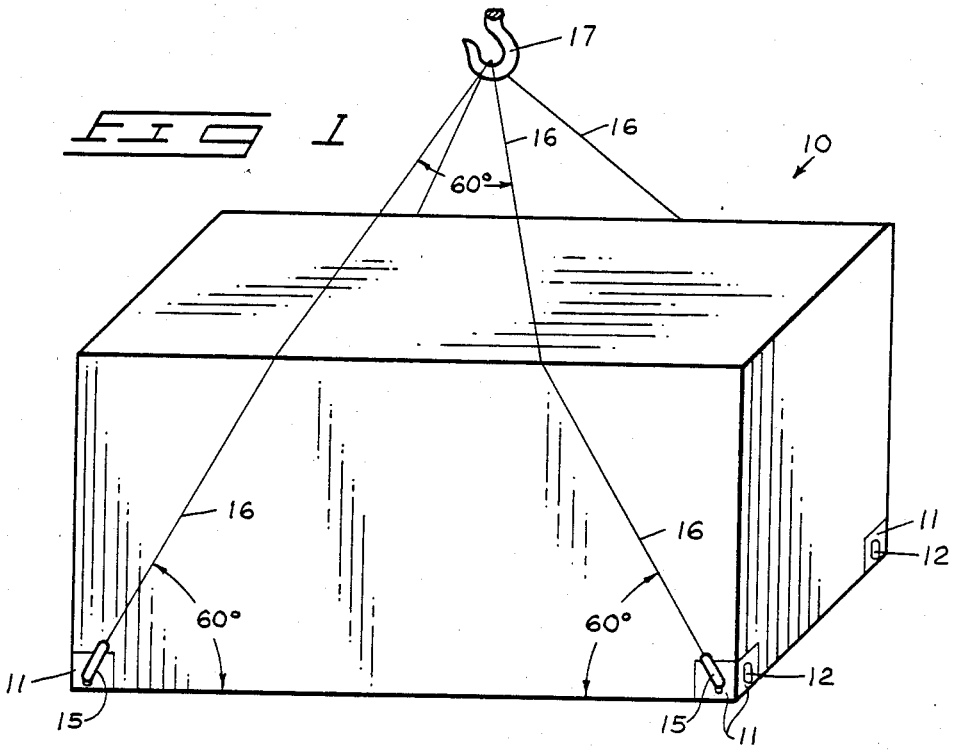
FIG. 1 is a pictorial view of the present lifting lugs being used in hoisting a shipping container.

FIG. 1 illustrates, in diagrammatic form, a typical cargo container 10. The cargo container 10 may be of a standard form used extensively in the maritime freight shipping industry for transport of assorted cargo. The container 10 includes lift fittings 11 at each of the bottom corners. The container may also include fittings at the upper corners (not shown). However, for purposes of this disclosure, the bottom lift fittings 11 may be used exclusively to facilitate ease and placement and removal of the present lifting lug.

Each of the lift fittings 11, as shown by FIGS. 1–3 and 6, include upright slots 12. The slots 12 are parallel across the container, and of an upright oblong orientation. A cavity 13 is provided inward of each slot 12 as shown in FIG. 6.

The present lifting lug is generally indicated at 15. It is specially adapted to be connected to the standard lift fittings 11 and for connecting free ends of choker cables 16 to the hoist hook 17 or equivalent lifting device of a standard crane or derrick (not shown).

It is pointed out that the choker cables 16 are typically of equal lengths sufficient to extend to the four bottom corners of the container. It is also typical that the distance between engaged corners along one side of a shipping container is equal to the common choker length. Thus, an equilateral triangle is formed by two cables on the same side of the container, with the bottom container wall. The same triangle is formed on the opposite side of the container. The angles of the cables and lifting lugs are therefore consistent of 60° due to the equilateral geometry of the connections. This consistent angle is used to advantage with the present lifting lug as will be found from further description below.

Details of the present lifting lug 15 are shown in FIGS. 4 through 8. The present lug is shown including an elongated rigid bar 20. The bar 20 is formed of a strong, wear-resistant material such as steel and extends along its length between a first end 21 and a remaining, second end 23. Opposed areal side surfaces 24 and 25 also extend between ends 21 and 23. An offset 26 may be provided adjacent the first bar end 21. The offset 26, as indicated in FIGS. 4 and 6, locates the one side surface 24 in laterally spaced relation to the same surface at the second bar end. The offset thus spaces the first bar end outwardly of the sides of the cargo container to allow clearance for shackles (not shown) on the choker cables 16.

An aperture 29 is provided at the first bar end 21 as means for attachment to the choker line. The choker line, as briefly indicated above, may include shackles or other appropriate fastening devices that can be releasably or permanently attached to the bar 20 through the provided aperture 29.

A cargo container engaging means 31 is located at the second bar end 23 for releasably locking the bar to a container 10 in alignment with the attached choker cable 16 when the cable is tensioned to lift the cargo container as demonstrated in FIG. 1. Means 31 may include a pivot shank 32 extending outwardly from the bar 20 in a direction opposite the offset 26. The shank 32 is oriented with its central pivot shank axis X—X (FIG. 4) transverse to the length of the bar and to a longitudinal bar axis Y—Y that bisects the bar length.

The shank 32 includes an end 34 fitted through an appropriate aperture in the bar to a position approximately flush with the bar side surface 25. The shank 32 extends through the bar to an outer end 35 and is secured by welds 36 on both bar sides 24 and 25. This doubly assures a rigid, stationary attachment between the pivot shank and bar.

The outer end 35 of pivot shank 32 rigidly mounts a keeper means 38. Preferably, the keeper means 38 is formed integrally with the pivot shank. However, it is conceivable that the keeper 38 could be attached by means of welding in a manner similar to that which the pivot shank is attached to the bar. The keeper means 38 includes a configuration complementary to that of the typical lift fitting slot 12 within a cargo container 10.

Figure 2:
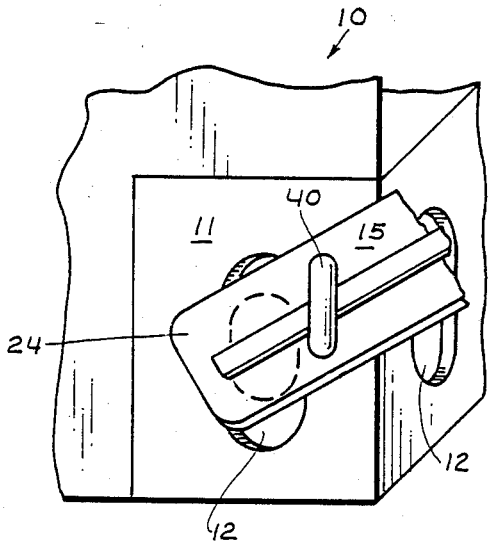
FIG. 2 is a fragmented view illustrating initial insertion of the device through a slotted corner fitting of a shipping container.
Figure 3:
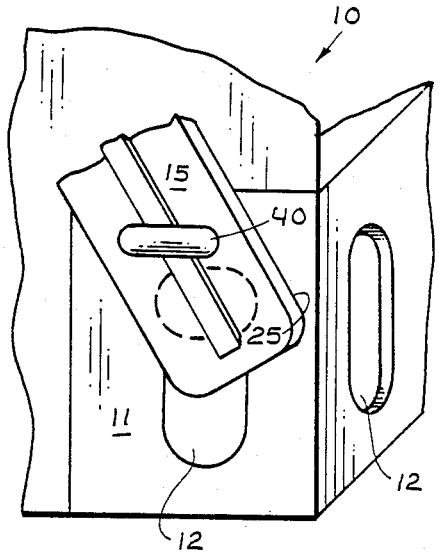
FIG. 3 is a view similar to FIG. 2 only showing an operative position of the lifting lug in relation to the slotted corner fitting of the shipping containers.

The keeper member 38 is provided as means for locking the present lug 15 to the cargo container upon pivotal motion of the bar 20 to a first prescribed angular relationship as shown in FIG. 3; and for unlocking the lug from the container upon pivotal motion of the bar to a second prescribed angular relationship to the container as indicated in FIG. 2. Thus, the keeper member 38 is preferably secured at a prescribed angular orientation to the bar member. This angle is indicated in FIG. 7 in relation to the longitudinal reference axis Y—Y as being 60°. This angle corresponds to the angle of the associated choker cable 16 when drawn taut in lifting the associated cargo container. Thus, when the cables are drawn tight, the bars 20 will automatically assume an orientation with respect to the lift fittings 11 such that the keeper members 38 are oriented transverse to the slots and securely locked in position. The lugs cannot be disengaged from the container unless the cables are slackened sufficiently to allow pivotal motion of the bars to an orientation in which the keeper members 38 are in vertical alignment with the slots 12. At that time the lug can be removed from the container and shifted with the remaining choker assemblies to the next container for reconnection.

An indicator means is provided at 40 for showing the exact angular orientation of the keeper member 38 at all times. The indicator means 40 may be comprised of an elongated rod permanently affixed to the lug along a longitudinal brace 43. The rod is parallel lengthwise to the keeper member 38.

Left and right hand versions of the lug are preferably used. Such versions are indicated in FIG. 1 and in somewhat more detail by FIGS. 5 and 8. The difference between right and left hand versions of the present lug is simply in the orientation of the keeper members 38 and indicators 40. The members 38 and indicators 40 are opposite one another due to the opposite inclination of the opposed lugs when engaged with a shipping container 40 as indicated in FIG. 1.

Installation and removal of the present lug to a shipping container is accomplished very quickly and in a simple operation.

The worker first orients the bar such that the indicator 40 is oriented vertically in alignment with the associated lift fitting slot 12. He then inserts the keeper member 38 through the complementary slot 12 such that it projects through into the fitting cavity 13. The bar 20 can then be rotated slightly to bring the elongated ends of the member 38 out of alignment with the slot, consequently locking the member within the cavity. The angular orientation of the keeper member 38 will be maintained in the initial locked condition by very slight tension of the choker cables which, when slack, tend to gravitate toward a vertical orientation from the central hoist hook 17. Thus, the slack cables will hold the bars in position with the members 38 locked to the lift fittings 11 once the lugs have been properly positioned. Care is taken to note the position of the indicator 40 as it will tell the worker whether the lug belongs on the right or left side of the cargo container. Other indicating devices not shown, such as color coding or appropriate markings can also be used for this purpose.

Once the lugs are properly positioned on the cargo container, tension can be applied to the choker cables through the hoist hook 17. This draws the cables up taut. With consistent equal cable lengths and distances between fittings on the same side of the container, this angular relationship remains a consistent 60°. Thus, the keeper member 38 will be rotated to a horizontal orientation when the bar is pulled to the 60° angle by the choker cable. The members 38 are held by the taut choker cables in transverse orientation to the upright slots 12 and are securely locked in position to the lift fitting. The container can then be maneuvered without fear that the lugs will work loose and drop the container.

Once the container is moved into a desired position, the hoist hook can be lowered to slack the choker cables. A dock worker can then pivot the bars back to a release orientation wherein the indicators 40 are upright and the associated keeper members 38 are vertical. The keeper members 38 can then be pulled through the slots, freeing the lugs from the cargo container. Once all the lugs have been removed from the container, the hoist, chokers, and attached lugs 15 can be moved back for attachment to the next successive container.

It is pointed out that the present lug structure is unitized. That is, there are no moving parts. This both eliminates the chance of mistake by the dock worker and damage by wear or corrosion experienced by other forms of lug mechanisms making use of various moving parts. Unitized construction reduces initial cost of the lugs and increases efficiency in loading and unloading containers from ships.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. Lifting lugs for releasably locking free ends of equal length choker lines leading from a hoist, to container lift fittings having slots formed therein at corners of a shipping container, wherein each lug comprises:

an elongated bar having mounting means at one end for attachment to the free end of a choker line, and a remaining end;

a pivot shank rigidly fixed to and extending transversely from the bar at the remaining end thereof;

a keeper member rigidly fixed to the pivot shank, having a configuration complementary to the slot of a container lift fitting, spaced clear of the bar by the pivot shank;

wherein the keeper member is angularly oriented on the elongated bar such that the keeper member will be positioned transverse to the container slot as the attached choker line is drawn taut by the hoist; and indicator means on the bar for displaying the angular orientation of the keeper member to the bar length.

2. The lifting lug as claimed by claim 1 wherein the indicator means is comprised of an elongated rod affixed to the bar on a side thereof opposite the keeper member.

3. The lifting lug as claimed by claim 1 wherein the bar includes opposed side surfaces and wherein the pivot shank and keeper project from one of said side surfaces and wherein the bar includes an offset adjacent the one end such that the mounting means at the one end is spaced from the one side surface.

4. The lifting lug as claimed by claim 1 wherein the mounting means is comprised of an aperture formed through the bar at the one end thereof.

5. The lifting lug as claimed by claim 1 wherein a longitudinal reference axis passes through the length of the bar between the mounting means and pivot shank;

wherein the keeper member is elongated along a fixed axis; and wherein the keeper axis is oriented at a fixed acute angular relation to the longitudinal axis of the bar.

6. The lifting lug as claimed by claim 5 wherein the inclusive angle between the keeper axis and longitudinal reference axis is approximately 60°.

7. The lifting lug as claimed by claim 1 wherein the bar includes one side and an opposite side and wherein pivot shank is received through the bar and has a shank end adjacent the one side of the bar and a remaining end projecting outwardly of the opposite side of the bar and wherein the pivot shank is welded to the bar at both sides thereof.

8. A lifting lug for attaching a choker cable to a standardized shipping cargo container having an upright lift slot, comprising:

an elongated bar extending between first and second ends;

integral mounting means at the first bar end for mounting a choker cable;

a pivot shank rigidly fixed to the bar at the second end and projecting to one side thereof; and elongated keeper means shaped complementary to the upright lift slot of the container and rigidly affixed to the pivot shank for reception within the lift slot of the cargo container and for locking within the slot in a horizontal orientation, transverse to the lift slot upon pivotal motion of the bar in response to lifting force being applied to the cable and for unlocking the lug from the cargo container upon pivotal motion of the bar to a second prescribed angular relationship with the container in response to lifting force being removed from the cable.

9. The lifting lug as claimed by claim 8 further comprising indicator means on the bar for indicating the angular position of the keeper means at the first and second prescribed angular relationships.

10. The lifting lug as claimed by claim 9 wherein the indicator means is comprised of an elongated rod affixed to the bar on a side thereof opposite the keeper means.

11. The lifting lug as claimed by claim 8 wherein the bar includes opposed side surfaces and wherein the pivot shank and keeper means project from one of said side surfaces and wherein the bar includes an offset adjacent the one end such that the mounting means at the one end is offset from the one side surface.

12. The lifting lug as claimed by claim 8 wherein the mounting means is comprised of an aperture formed through the bar at the one end thereof.

13. The lifting lug as claimed by claim 8 wherein a longitudinal reference axis passes through the length of the bar between the mounting means and pivot shank;

wherein the keeper means member is elongated along a fixed axis; and wherein the keeper means axis is oriented at a fixed acute angular relation to the longitudinal axis of the bar.

14. The lifting lug as claimed by claim 13 wherein the inclusive angle between the keeper axis and longitudinal reference axis is approximately 60°.

15. The lifting lug as claimed by claim 8 wherein the bar includes one side and an opposite side and wherein pivot shank is received through the bar and has a shank end adjacent the one side of the bar and a remaining end projecting outwardly of the opposite side of the bar and wherein the pivot shank is welded to the bar at both sides thereof.

16. A lifting lug for attaching a cargo choker cable to a shipping cargo container having elongated lift lug receiving slots, comprising:

a rigid elongated bar extending between a first end and a second end;

means at the first bar end for mounting a choker cable; and cargo container engaging keeper means rigidly affixed at the second bar end for reception within a lug receiving slot of a cargo container and for locking in a transverse orientation within the slot and with the bar in alignment with the attached choker cable when the choker cable is tensioned to lift the cargo container.

17. The lifting lug as claimed by claim 16 further comprising indicator means on the bar for indicating the angular position of the keeper means in relation to the elongated bar.

18. The lifting lug as claimed by claim 17 wherein the indicator means is comprised of an elongated rod affixed to the bar on a side thereof opposite the keeper means.

19. The lifting lug of claim 16 further comprising:

a pivot shank on the bar at the second end thereof; and wherein the keeper means is shaped complementary to the container slot and is rigidly affixed to the pivot shank and extends to opposite sides thereof.

* * * * *